US005698288A

United States Patent [19]

Barnes

[11] Patent Number: 5,698,288

[45] Date of Patent: Dec. 16, 1997

[54] PROTECTIVE COVERING FOR SWIM PLATFORM LOCATED ON A BOAT

[76] Inventor: Jeff Barnes, 12247 Old Stone Dr., Indianapolis, Ind. 46236

[21] Appl. No.: 726,692

[22] Filed: Oct. 7, 1996

[51] Int. Cl.[6] ..... B32B 9/00

[52] U.S. Cl. ..... 428/76; 428/82; 428/83; 428/85; 428/92; 428/99; 428/120; 428/119; 428/121; 428/124; 428/126; 428/131; 428/133; 428/137; 244/121; 114/361; 52/97; 52/300

[58] Field of Search ..... 428/76, 77, 82, 428/83, 85, 88, 92, 99, 192, 120, 119, 121, 122, 124, 126, 131, 133, 137; 52/300, 97; 244/121; 114/361

[56] References Cited

U.S. PATENT DOCUMENTS

| | | | |
|---|---|---|---|
| Re. 26,363 | 3/1968 | Mills . | |
| 2,732,877 | 1/1956 | Taylor . | |
| 2,864,391 | 12/1958 | Stark . | |
| 2,926,362 | 3/1960 | Collins . | |
| 3,572,353 | 3/1971 | Pinkley . | |
| 3,587,123 | 6/1971 | O'Boyle | 248/210 |
| 3,613,137 | 10/1971 | Eccles . | |
| 4,742,795 | 5/1988 | DePrey et al. | 114/362 |
| 5,092,262 | 3/1992 | Lacy | 114/361 |
| 5,136,963 | 8/1992 | Zuzik | 114/363 |
| 5,291,848 | 3/1994 | Wilhelm | 114/361 |

*Primary Examiner*—Patrick Ryan
*Assistant Examiner*—Abraham Bahta
*Attorney, Agent, or Firm*—Tom Hamill, Jr.

[57] ABSTRACT

A protective covering for a swim platform located on a boat is provided. The protective covering may be detachably attached over the top of a swim platform, such as those platforms which are located about the rear of boats or other marine craft. Use of the protective covering will prevent waterfowl or other animals from defecating, loitering or nesting on the swim platform. The covering includes a generally rectangular portion located intermediate a right wing portion and a left wing portion. A plurality of apertures designed to secure the covering to the swim platform are provided on the rectangular portion, right wing portion and left wing portion. Both the right wing and the left wing fold forming a right sidewall and a left sidewall. The sidewalls and rectangular portion form a hollow, generally triangular structure which is placed atop and resides in the area immediately atop the swim platform. The covering is securely attached to the swim platform by any of a variety of attachment means. This prevents any other objects from occupying the swim platform. By extending the length of the rectangular portion, the protective covering may also have application in preventing birds from defecating, loitering or nesting on building ledges.

20 Claims, 9 Drawing Sheets

PROTECTIVE COVERING FOR SWIM PLATFORM LOCATED ON A BOAT

BACKGROUND OF THE INVENTION

1. Field of the Invention

The present invention relates generally to protective coverings, and more particularly, to a protective covering for a swim platform located on a marine craft, especially adapted to prevent birds from defecating, loitering or nesting thereon.

2. Description of the Prior Art

It is well known to use protective coverings for boats in the form of tarps or other enclosures. These are employed during boat storage or during inclement weather. They are generally secured about the perimeter of the boat hull by ropes or other fastening devices. These devices are generally utilized to cover the entire surface of the boat for a period of time, and are not easily emplaced or removed. It is also known to cover cargo which may be stored on the deck of a vessel for a period of time with such a covering. Coverings of this type are generally lashed down to prevent their inadvertent displacement due to weather or wave action.

Although the foregoing discussion indicates it to be known to use tamps or like structure to cover an entire the boat the provision of a protective device which fits specifically over the swim platform is not contemplated. Nor does the prior art described above teach or suggest a protective covering which may be easily emplaced and removed. The foregoing disadvantages are overcome by the unique structure and design of the present invention as will be made apparent from the following description thereof. Other advantages of the present invention over the prior art also will be rendered evident.

SUMMARY OF THE INVENTION

To achieve the foregoing and other advantages the invention provides a protective covering may be detachably attached over the top of a swim platform, such as those platforms which are located about the rear of boats or other marine craft. Use of the protective covering will prevent waterfowl or other animals from defecating, loitering or nesting on the swim platform. The covering includes a generally rectangular portion located intermediate a right wing portion and a left wing portion. A plurality of apertures designed to secure the covering to the swim platform are provided on the rectangular portion, right wing portion and left wing portion. These apertures are located generally as follows, the rectangular portion has an aperture located on the right side and the left side, the right wing has an aperture located on its left side, proximal to the rectangular portions right side aperture, and the left wing has an aperture located on its right side, proximal to the rectangular portions left side aperture. Both the right wing and the left wing fold forming a right sidewall and a left sidewall. The sidewalls and rectangular portion form a hollow, generally triangular structure which is placed atop and resides in the swim platform. The two pairs of apertures, one pair on the right side of the structure, and one pair on the left side of the structure, will receive a securing means therethrough such as a bungee cord. This cord would be fastened by conventional means to a securing point on the boat hull. A removable attachment device such as a suction cup may be employed to attach the cord to the rear of the boat. This would secure the protective covering in the swim platform ledges.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will form the subject matter of the claims appended hereto.

In this respect, before explaining at least the preferred embodiment of the invention in detail, it is to be understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which this disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is an object of the invention to provide a protective covering for a swim platform which may be placed atop a swim platform of a boat, which is especially adapted to prevent birds from defecating, loitering or nesting on the swim platform.

It is an object of the invention to provide a protective covering for a swim platform which may be employed to cover a swim platform enclosed within the transom of the boat or an open wood or fiberglass swim platform.

It is an object of the invention to provide a protective covering for a swim platform which may be easily attached and removed from the swim platform.

It is another object of the present invention to provide a protective covering for a swim platform which may be easily and efficiently manufactured and marketed.

It is a further objective of the present invention to provide a protective covering for a swim platform which is of durable and reliable construction.

An even further object of the present invention is to provide protective covering for a swim platform which is susceptible of a low cost of manufacture with regard to both materials and labor, and which accordingly is then susceptible of low prices of sale to the consuming public, thereby making such a protective covering for a swim platform available to the buying public.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawings wherein.

DESCRIPTION OF THE PREFERRED EMBODIMENT

With reference now to the drawings, a new protective covering for a swim platform embodying the principles and concepts of the present invention will be described.

Figure 1:
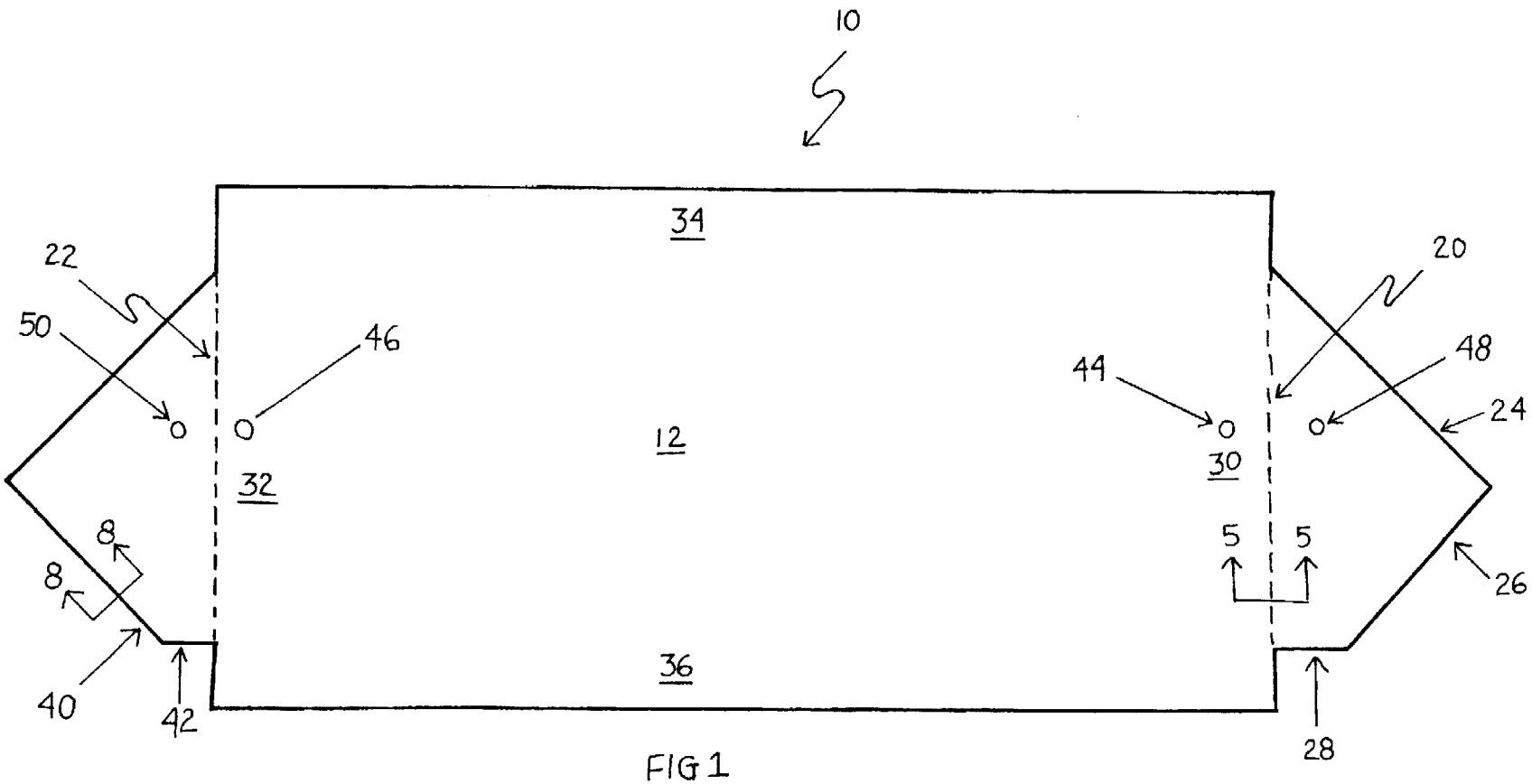
FIG. 1 is a top view showing the a preferred embodiment of the protective covering for a swim platform of the invention.

Turning initially to FIG. 1 there is shown the protective covering for a swim platform generally designated by reference numeral 10. In its preferred form, the protective covering 10 comprises a generally rectangular portion 12 located intermediate a right wing portion 14 and a left wing portion 16. The rectangular portion 12 includes a right side 30, a left side 32, a top side 34 and a bottom side 36. The right wing portion 14 may fold about a first fold line 20. The first fold line 20 represents a living hinge which will best be seen in FIGS. 5–7. The right wing portion 14 may also be integral with the right side 30 of the rectangular portion 12 in some embodiments of the invention. The left wing portion 16 may fold about a second fold line 22. The second fold line 22 represents a living hinge which will best be seen in FIGS. 5–7. The left wing portion 16 may also be integral with the left side 32 of the rectangular portion 12 in some embodiments of the invention. In an embodiment of the invention the fold lines 20 and 22 occur at, and further designate, a living hinge. Other means of attaching wing structure to the rectangular portion 12 may be provided. These include separate wing portions being attached to the rectangular portion 12 with conventional hinges to permit rotation about the fold lines 20 and 22. Both the right wing portion 14 and the left wing portion 16 assume a generally triangular shape. The right wing portion 14 includes a first side 24, a second side 26, a third side 28, and a fourth side which is connected to the rectangular portion 12 about fold line 20. The left wing portion 16 includes a first side 38, a second side 40, a third side 42 and a fourth side which is connected to the rectangular portion 12 about fold line 22.

A plurality of apertures are provided on the rectangular portion 12, right wing portion 14 and left wing portion 16. In the preferred embodiment the apertures are located generally as follows, the rectangular portion 12 has a right side aperture 44 located on the right side 30 and a left side aperture 46 located on the left side 32. Further the right wing 14 has a right wing aperture 48 located thereon and the left wing 16 has a left wing aperture 50 located thereon. The precise position of the apertures may vary with the various dimensions of protective covers 10. The apertures are designed to receive an elastic cord, rope, strap bungee cord or the like therethrough to secure the protective cover 10 to the boat. The preferred means of employing the elastic cord, rope or the like to secure the protective cover 10 will best be seen in subsequent FIGS. 2–4.

The protective cover 10 may be manufactured from any of a variety of materials including fiberglass, plastic, vinyl, nylon-acrylic compositions, fabrics or treated wood. It is to be understood that any material which has the desirable mechanical properties may be employed to manufacture the protective cover 10.

Figure 2:
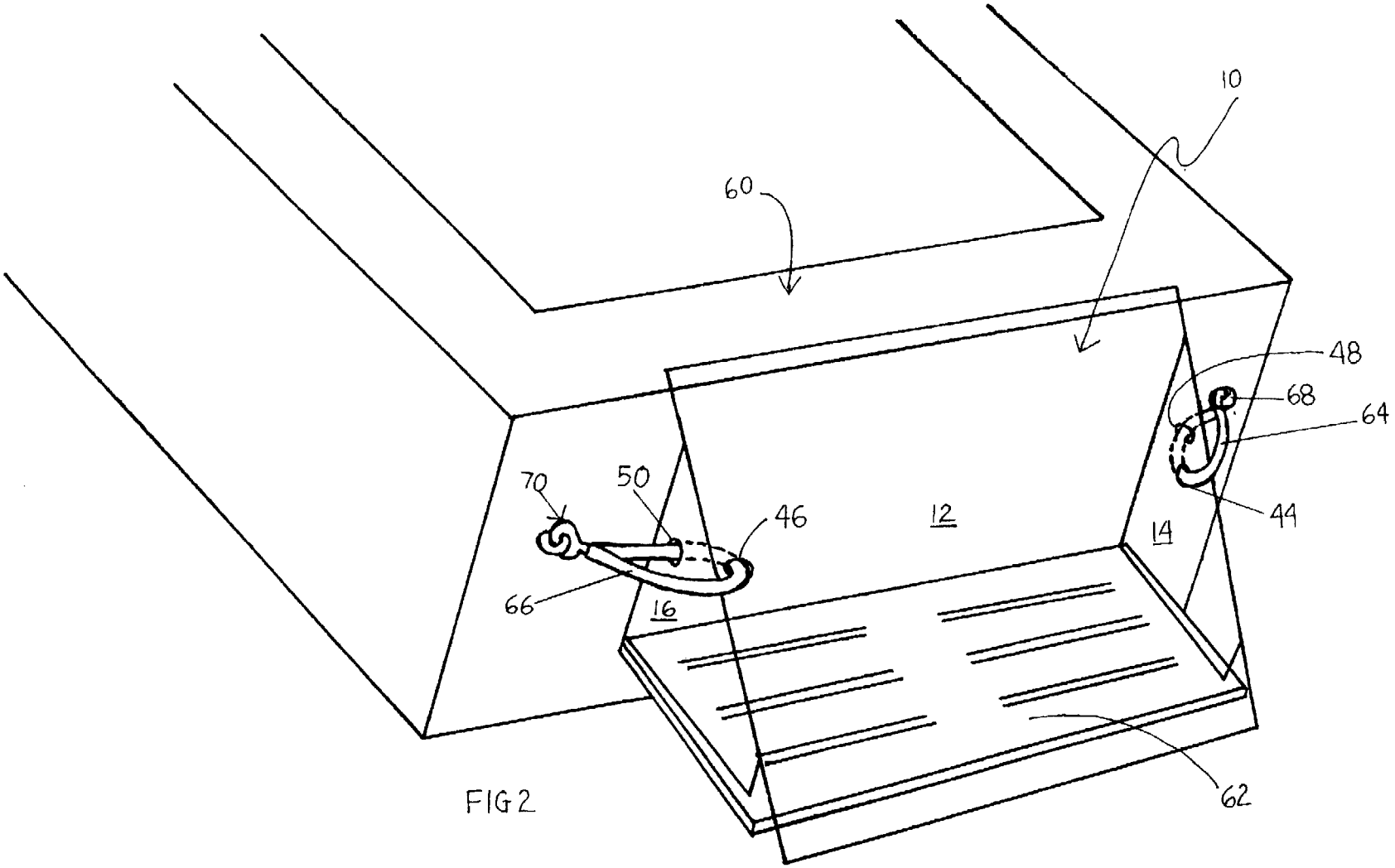
FIG. 2 is an environmental perspective view of the protective covering for a swim platform being used on a first type of swim platform with a first connection method.

Referring now specifically to FIG. 2, the protective cover 10 is shown being attached to the swim platform 62 of a boat 60. The swim platform 62 is an open wood or fiberglass platform which is affixed to the rear of the boat 60. The protective covering 10 resides in the region above the swim platform 62. The right wing portion 14 acts as a first leg and sidewall and the left wing portion 16 acts a second leg and sidewall. A first cord 64 acts as the protective covering first attachment means and passes through the right side aperture 44 and the right wing aperture 48 and is affixed to a securing point 68 located on the boat 60. Securing point 68 will be located on the right rear of the boat 60. A second cord 66 acts as the protective covering second attachment means and passes through the left side aperture 46 and the left wing aperture 50 and is affixed to a securing point 70 located on the boat 60. Securing point 70 will be located on the left rear of the boat 60. The first cord 64 and second cord 66 may be an elastic cord, such as a bungee cord, or a non-elastic cord, such as a rope. Other elongated devices may also be utilized. The first cord 64 and the second cord 66 secure the protective covering 10 above the swim platform 62. Both the securing points 68, 70 are located outside of the protective covering 10. The right wing portion 14, left wing portion 16, and rectangular portion 12 form a generally triangular housing which resides atop the swim platform 62. The rectangular portion 12 has a slope of about a 45 degree angle as shown. This 45 degree angle will prevent birds and vermin from landing on the swim platform 62.

Figure 2A:
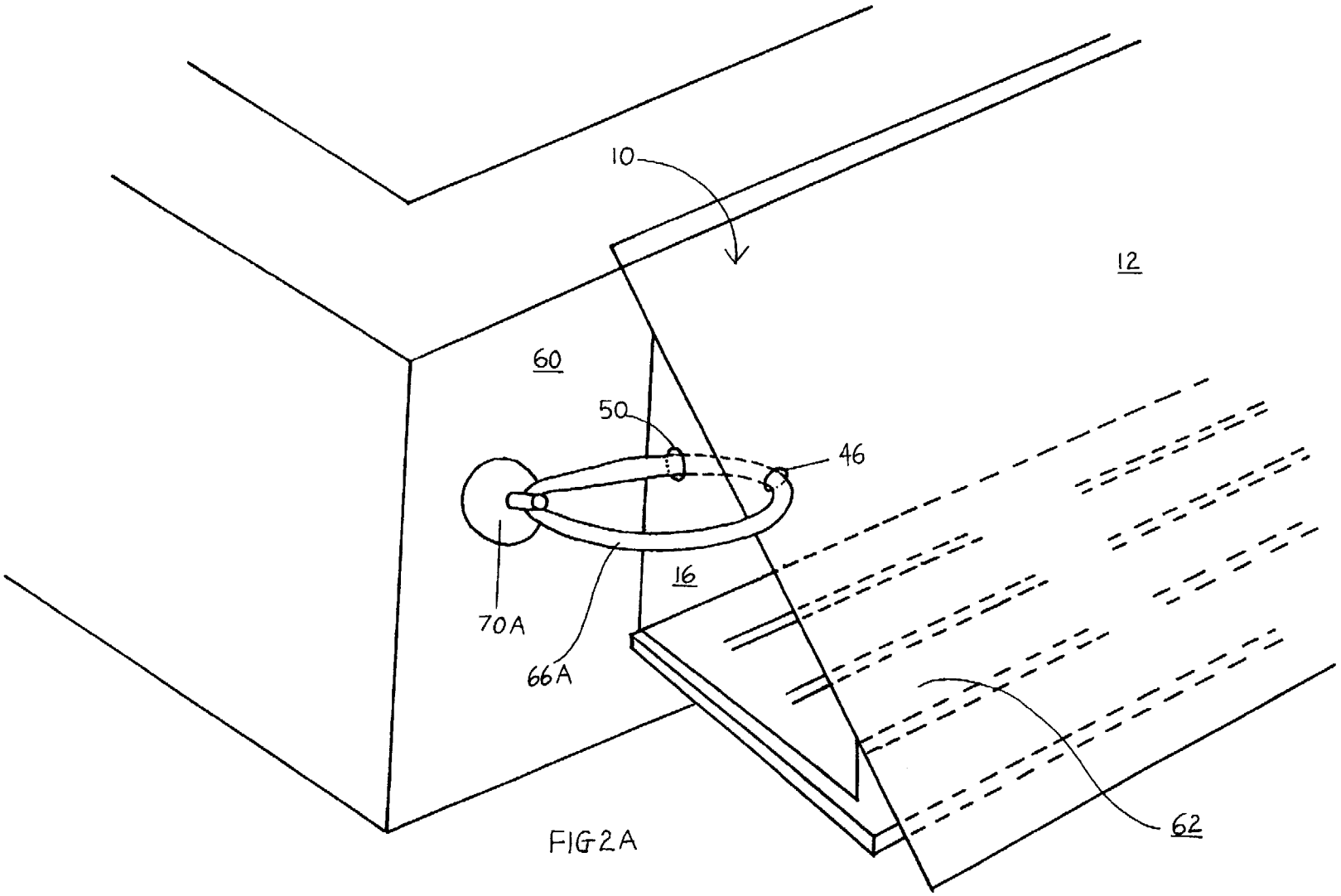
FIG. 2A is a view showing an alternative means of securing the protective covering for a swim platform to the boat.

Referring now specifically to FIG. 2A, an alternative method of securing the cover 10 is shown. Cord 66A is attached to a suction cup device 70A. The suction cup device 70A will be affixed to the boat 60. Identical structure will be employed on both the right and left sides of the cover 10.

Figure 3:
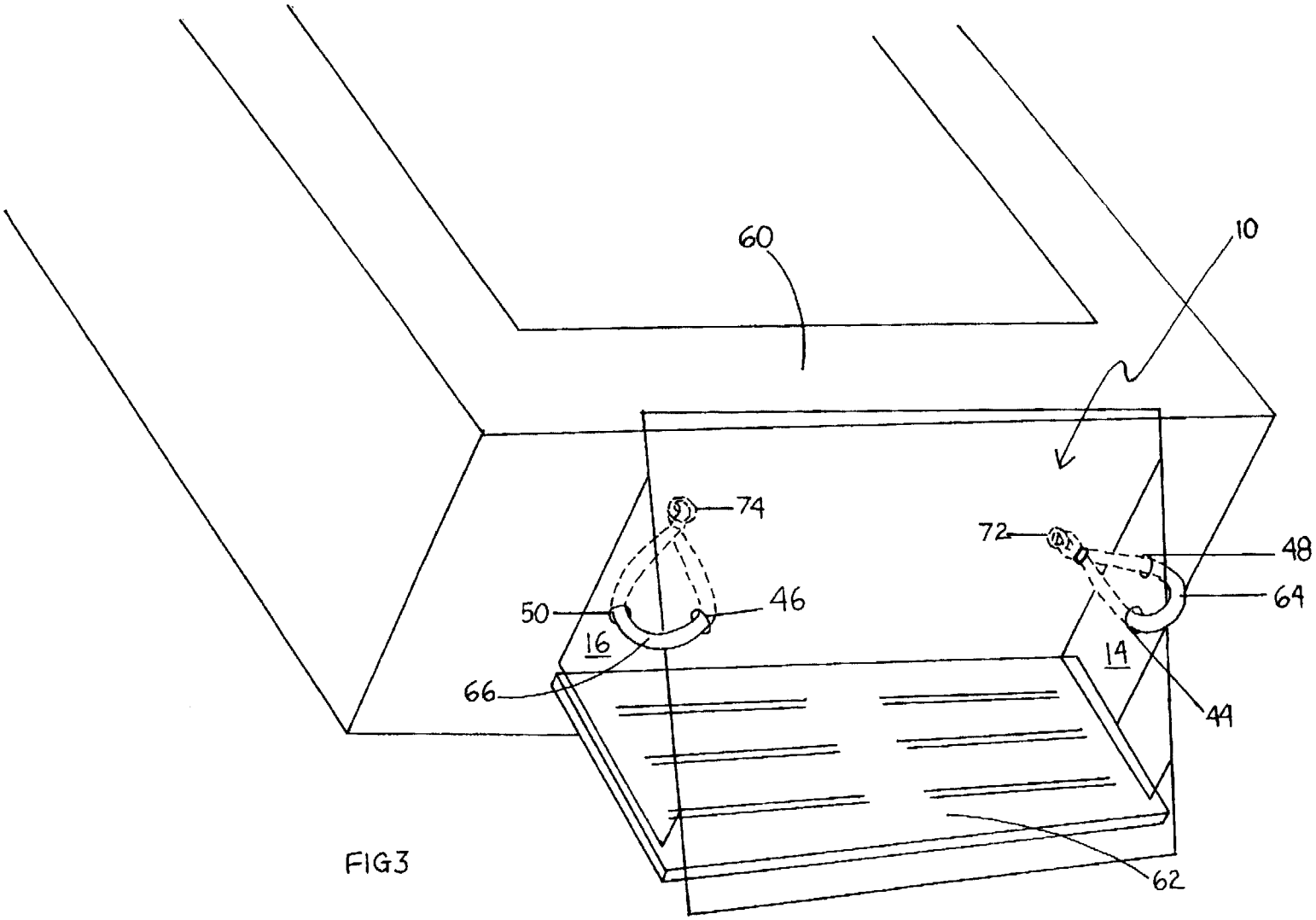
FIG. 3 is an environmental perspective view of the protective covering for a swim platform being used on a first type of swim platform with a second connection method.

Referring now specifically to FIG. 3, the protective cover 10 is shown being attached to the swim platform 62 of a boat 60. The swim platform 62 is an open wood or fiberglass platform which is affixed to the rear of the boat 60. The protective covering 10 resides in the region above the swim platform 62. The right wing portion 14 acts as a first leg and the left wing portion 16 acts a second leg. A first cord 64 passes through the right side aperture 44 and the right wing aperture 48 and is affixed to a securing point 72 located on the boat 60. A second cord 66 passed through the left side aperture 46 and the left wing aperture 50 and is affixed to a securing point 74 located on the boat 60. The first cord 64 and second cord 66 may be an elastic cord, such as a bungee cord, or a non-elastic cord, such as a rope. The first cord 64 and the second cord 66 secure the protective covering to above the swim platform 62. Both the securing points 72 & 74 are located outside of the protective covering 10. The right wing portion 14, left wing portion 16, and rectangular portion 12 form a generally triangular housing which resides atop the swim platform 62. The rectangular portion 12 has a slope of about a 45 degree angle as shown. This 45 degree angle will prevent birds and vermin from landing on the swim platform 62.

Figure 4:
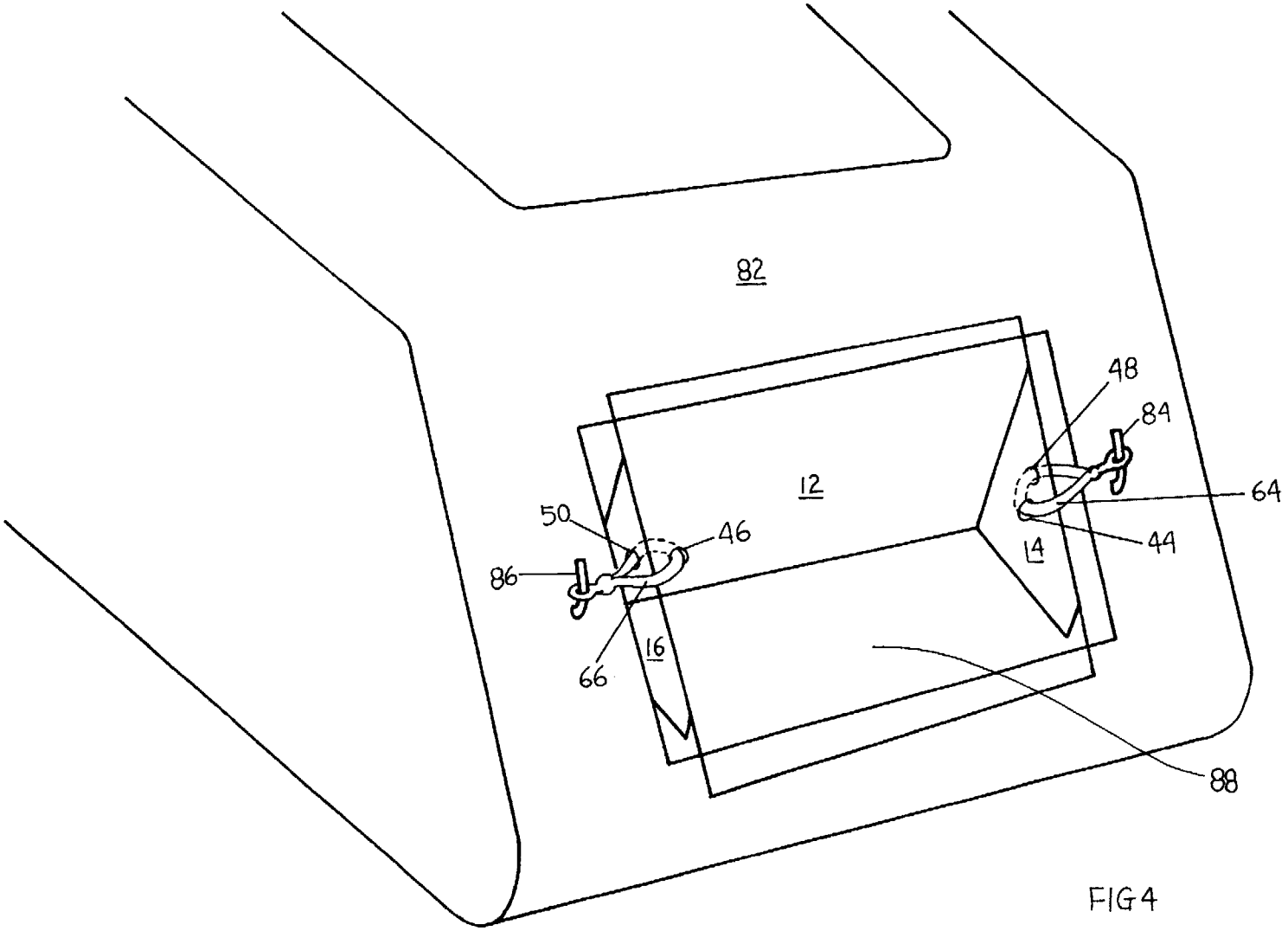
FIG. 4 is an environmental perspective view of the protective covering for a swim platform being used on a second type of swim platform.

Referring now specifically to FIG. 4, the protective cover 10 is shown being attached to the swim platform 80 of a boat 82. The swim platform 80 is of the enclosed fiberglass variety located within the transom of the boat 82. The protective covering 10 resides in the region above the swim platform 80. The right wing portion 14 acts as a first leg and the left wing portion 16 acts a second leg. A first cord 64 passes through the right side aperture 44 and the right wing aperture 48 and is affixed to a securing point 84 located on the boat 82. A second cord 66 passed through the left side aperture 46 and the left wing aperture 50 and is affixed to a securing point 86 located on the boat 82. The first cord 64 and second cord 66 may be an elastic cord, such as a bungee cord, or a non-elastic cord, such as a rope. The first cord 64 and the second cord 66 secure the protective covering 10 above the swim platform 62. Both the securing points 84 & 86 are located outside of the protective covering 10. The right wing portion 14, left wing portion 16, and rectangular portion 12 form a generally triangular housing which resides atop and encloses the swim platform 80. The rectangular portion 12 has a slope of about a 45 degree angle as shown. This 45 degree angle will prevent birds and vermin from landing on the swim platform 80.

It has also been proposed to extend the rectangular portion 12 to cover both securing points 84 & 86. In this embodiment, the right wing portion 14 and the left wing portion 16 will have the rectangular portion 12 overhanging their mutual perpendicular abutment. The attachment would be similar to that described in FIG. 3 where the attachment point lay within the generally triangular housing which is the cover 10.

Figure 5:
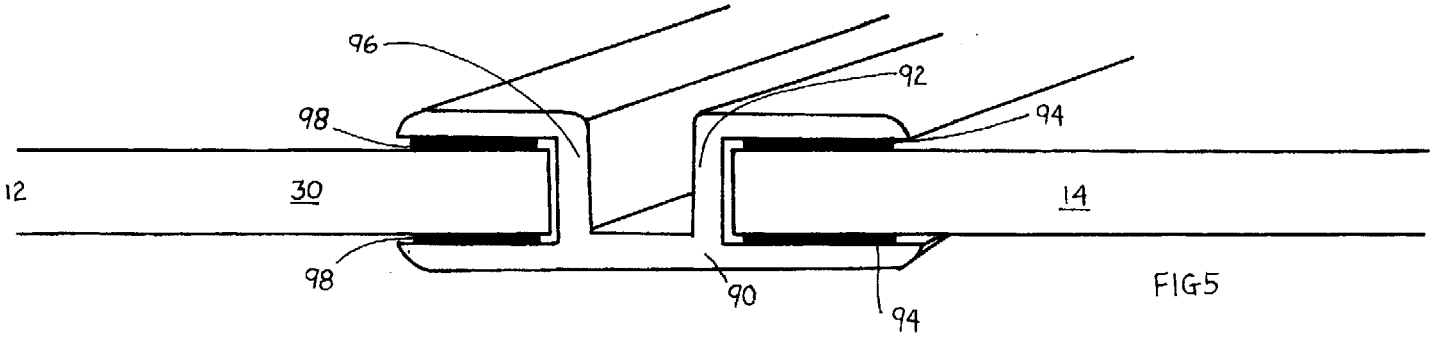
FIG. 5 is a partial cross-sectional view taken along 5—5 of FIG. 1.

FIG. 5 is a partial cross-sectional view taken along 5—5 of FIG. 1. The right wing portion 14 is shown connected to the right side 30 of rectangular portion 12 by the hinge structure 90. A first U-shaped element 92 is designed to receive the right wing portion 14 therein. A pressure sensitive adhesive 94 secures the right wing portion 14 within the first U-shaped element 92. A second U-shaped element 96 is designed to receive the right side 30 of the rectangular portion 12 therein. A pressure sensitive adhesive 98 secures the right side 30 within the second U-shaped element 96. It is to be understood that any of a variety of connection devices may be employed to secure the wing portions to the rectangular portion. Also, there are any of a great number of different adhesives which would be acceptable for the purpose above described. It may also be easily seen that other means to affix the rectangular and wing portions in the U-shaped elements may be provided. Mechanical fasteners such as nuts and bolts, screws or nails may be employed for this purpose.

Figure 7:
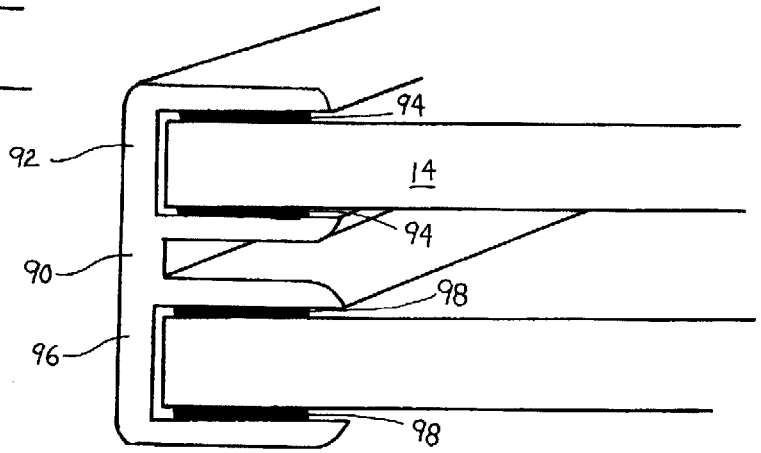
FIG. 7 is a partial cross-sectional view of the protective covering for a swim platform taken along the fold line demonstrating 180 degrees of rotation.
Figure 6:
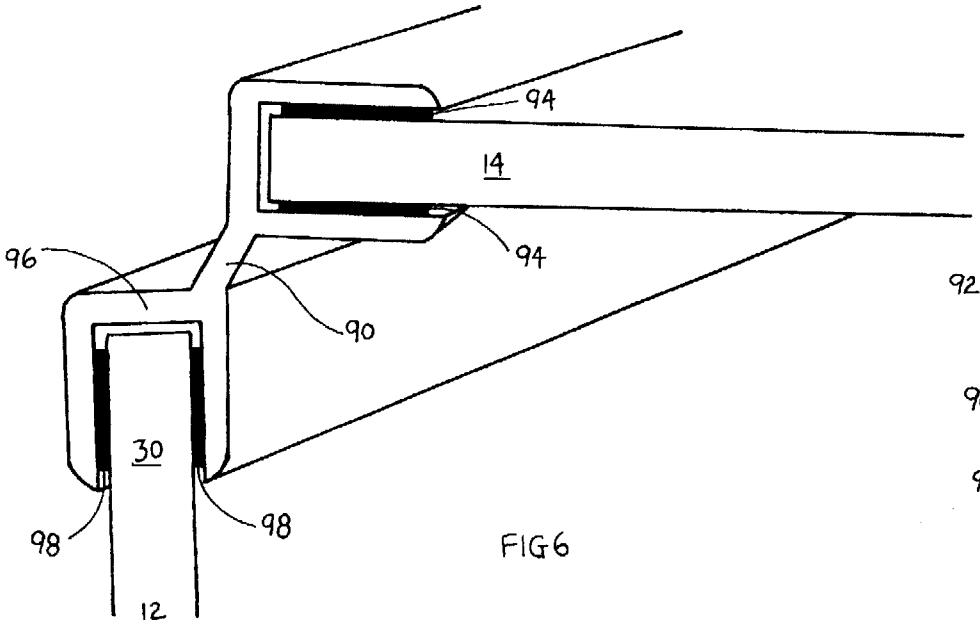
FIG. 6 is a partial cross-sectional view of the protective covering for a swim platform taken along the fold line when the covering is in the upright position.

FIGS. 6 and 7 are provided to demonstrate the flexibility of the hinge 90. Hinge 90 may flex through a complete 180 degrees. It is to be noted that FIGS. 5–7 show identically the hinge structure which would appear intermediate the left wing portion 16 and the left side 32 of the rectangular portion 12.

Figure 8:
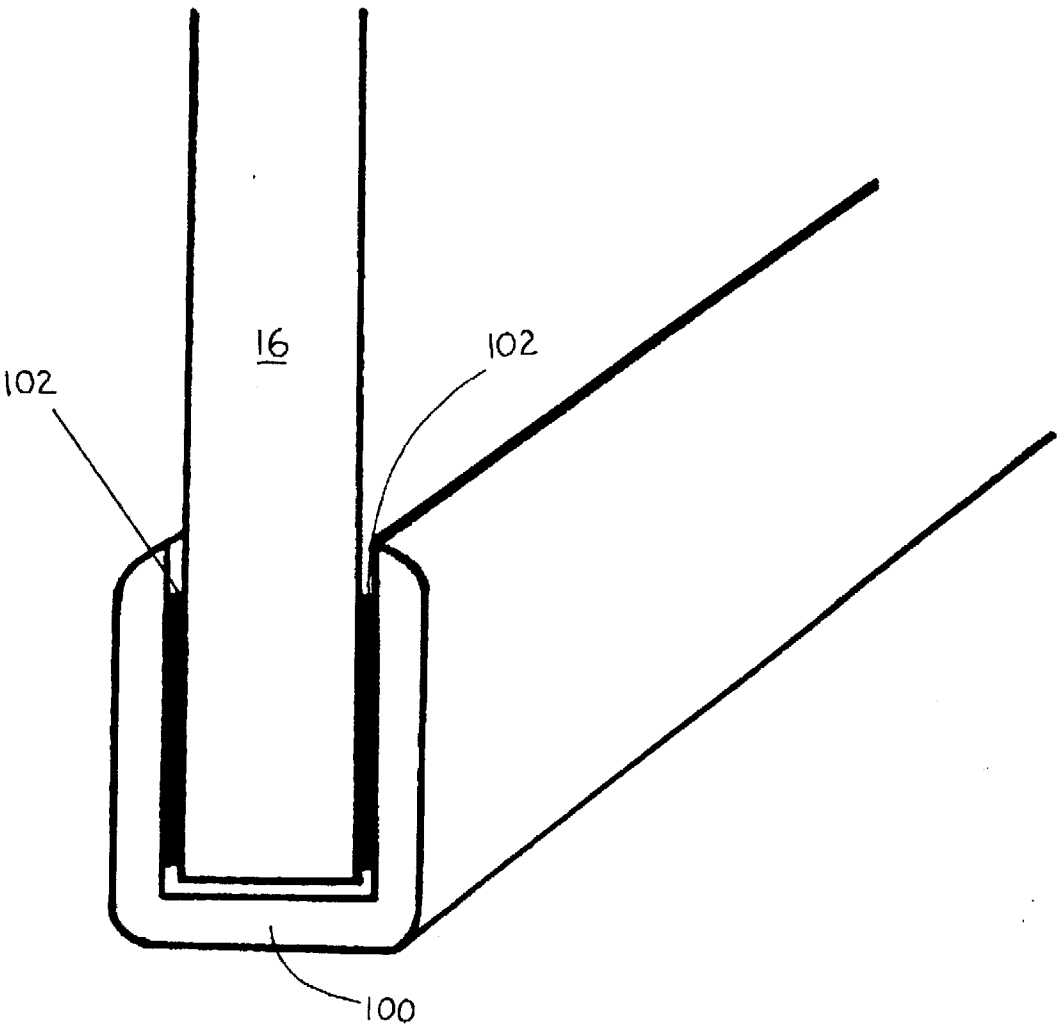
FIG. 8 is a partial cross-sectional view of the protective covering for a swim platform taken along line 8—8 of FIG. 1.

FIG. 8 is a partial cross-sectional view of the protective covering for a swim platform taken along line 8—8 of FIG. 1. Left wing portion 16 is shown enclosed in a third U-shaped element 100. A pressure sensitive adhesive 102 secures the left wing portion 16 within the first U-shaped element 100. The third U-shaped element 100 preferably may be vinyl although other like materials may be employed. The above discussion concerning use of alternative adhesives is pertinent with respect to adhesive 102 as well. The third U-shaped element 100 acts as a shoe for the leg of the left wing portion 16. Identical structure is present on the right wing portion 14. Some versions of the protective covering 10 may have identical U-shaped structure completely covering its exposed perimeter. Such structure would increase the integrity of the protective covering 10 and help protect it against damage or decay.

Figure 9:
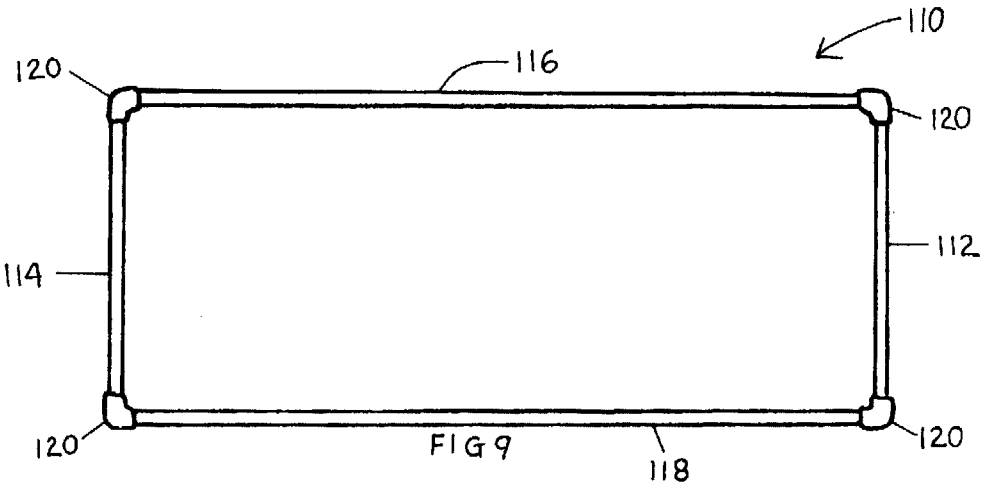
FIG. 9 is a view of the rectangular brace used to support another embodiment of the protective covering for a swim platform.

Referring now to FIG. 9, a rectangular support structure 110 for a further embodiment of the covering for a swim platform is shown. The rectangular structure 110 includes a right element 112, a left element 114, a top element 116, and a bottom element 118. These aforementioned elements (112, 114, 116, & 118) are all interconnected to form a rectangle by interconnection elements 120. It is proposed that the rectangular support structure may be comprised of plastic tubing of an appropriate diameter. A preferred plastic material is PVC tubing. The rectangular structure 110 may alternatively be of a unitary construction. The rectangular structure 110 will be placed atop the swim platform on the boat once interfitted in the covering structure which will be described below.

Figure 10:
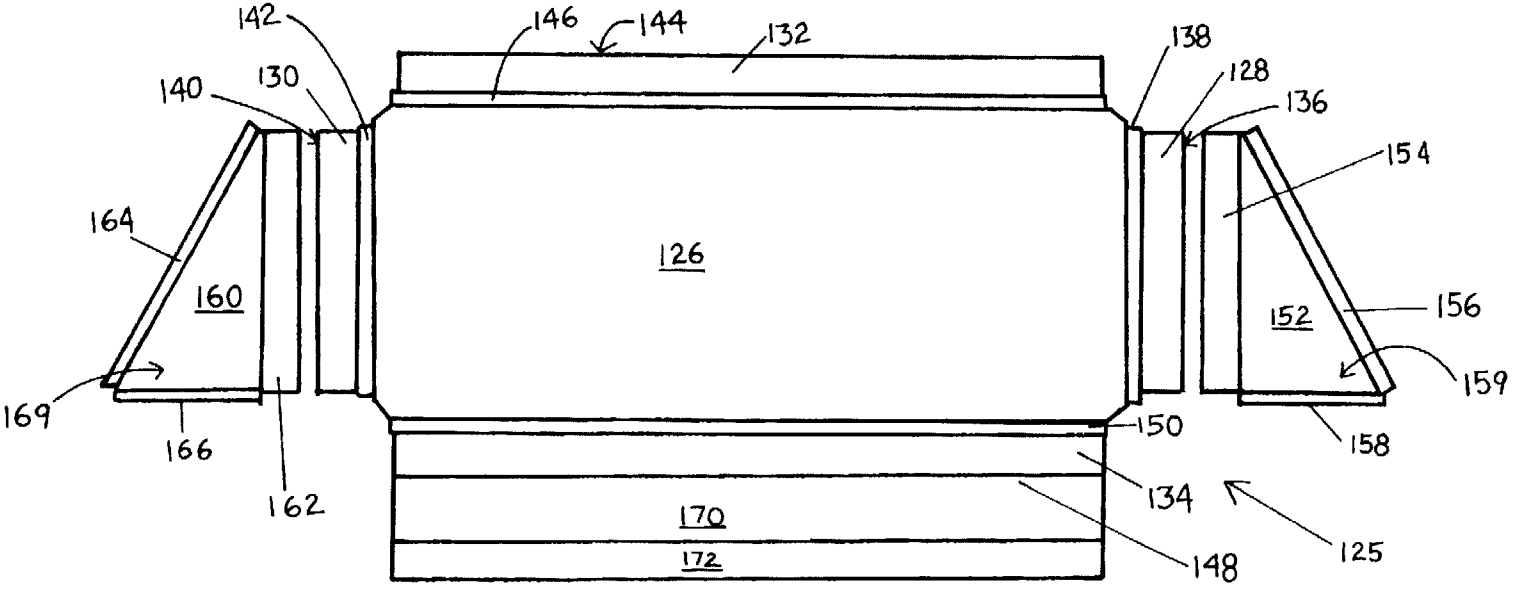
FIG. 10 is a view of the covering element which is mated with the rectangular brace of FIG. 9.

FIG. 10 shows the covering element 125 which will be secured to the rectangular structure 110. The covering element 125 is made of a durable and flexible material such as fiberglass, plastic, vinyl, nylon-acrylic compositions, or other fabrics. The covering element 125 would preferably have water resistant qualities. The covering element 125 includes a central rectangular portion 126. A right sleeve 128, a left sleeve 130, a top sleeve 132 and a bottom sleeve 134 are provided. Right sleeve 128 has an outer side 136 which is brought about to element 138. Outer side 136 is secured to element 138 forming the right sleeve 128. The outer side 136 is secured to element 138 by heat welding, stitching or other means. Left sleeve 130 has an outer side 140 which is brought about to element 142. Outer side 140 is secured to element 142 forming the right sleeve 130. The outer side 140 is secured to element 142 by heat welding, stitching or other means. Top sleeve 132 has an outer side 144 which is brought around to element 146 forming the top sleeve 132. The outer side 144 is secured to element 148 by heat welding, stitching or other means. Bottom sleeve 134 has an outer side 148 which is brought about to element 150. The outer side 148 is secured to element 150 by heat welding, stitching or other means. The rectangular support element 110 of FIG. 9 side elements (112,114,116,& 118) are received in the sleeves (128, 130, 132, 134) respectively.

A right wing element 152 is provided. The right wing element 152 is generally triangular. The right wing element 152 includes a connection strip 154. Connection strip 154 may be secured to element 138 by heat welding, stitching or other means including hook and loop fasteners. Right wing element 152 is affixed in such a manner to permit it to hang downwardly with respect to the central rectangular element 126 forming a right sidewall. Protective strips 156 and 158 are formed on the outer perimeter of the right wing element 152. The protective strips 156 and 158 are designed to be folded over and affixed by heat welding or stitching. This forms a more durable perimeter portion which will resist tearing, fraying or degrading. A weight may be retained at location 159. This weight causes the right wing element 152 to remain hanging.

A left wing element 160 is provided. The left wing element 160 is generally triangular. The left wing element 160 includes a connection strip 162. Connection strip 162 may be secured to element 142 by heat welding, stitching or other means including hook and loop fasteners. Left wing element 160 is affixed in such a manner to permit it to hang downwardly with respect to the central rectangular element 126 forming a left sidewall. Protective strips 164 and 166 are formed on the outer perimeter of the left wing element 160. The protective strips 164 and 166 are designed to be folded over and affixed by heat welding or stitching. This forms a more durable perimeter portion which will resist tearing, fraying or degrading. A weight may be retained at location 169. This weight causes the left wing element 160 to remain hanging. Flap element 170 will hang over the rear boat edge. A pocket 175 to retain weights will be affixed to and located below flap element 170.

There are two possible orientations for the attachment of the right wing element 152 and the left wing element 160, the first, being affixed to the underside of the central rectangular portion 126, and second, being affixed to the upper side of central rectangular portion 126. Although both these points of attachment have been considered, the preferred placement of the wing elements will be to the underside of the central rectangular portion 126.

Figure 11:
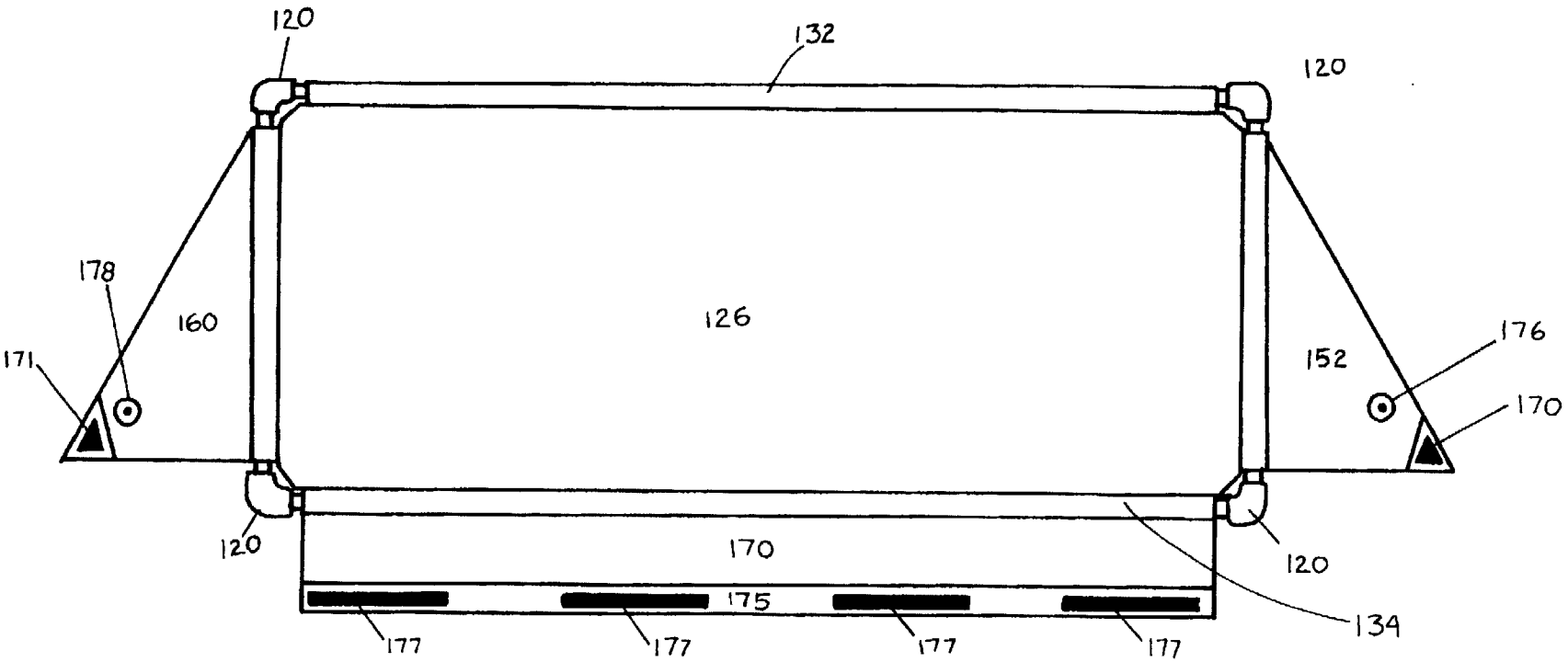
FIG. 11 is a view showing the covering element mated with the rectangular brace.

FIG. 11 shows the covering 125 mounted on the rectangular frame 110. Many of the elements have been described in the previous figures. The brace elements reside within the sleeve elements. Weights 170 and 171 may be secured on the right and left wing elements (152, 160) respectively. In the case of PVC fabric, the weights may be heat welded into the material. Elements 176 & 178 represent reinforced apertures which will permit a securing cord to pass therethrough. The cord will be affixed to the rear of the boat by any of a plurality of conventional means, including those previously described. Pocket 175 may retain additional weights 177. The weights 177 will cause flap 170 to be retained in a downward fashion.

The frame 110 and covering 125 will be placed atop the swim platform of the boat. The right wing 152 and the left wing 160 will form right and left sidewalls. They will be affixed to the boat by cords which are either attached to the rear of the boat by hooks or suction cups. The entire structure will give the appearance of a triangular housing. By placing the protective covering atop the swim platform, animals are prevented from loitering thereon.

It has been considered that similar structures to the above describe embodiments may also be employed to protect ledges of buildings from bird and animal habitation and wastes. By extending the rectangular portion, one may cover an entire ledge of a building. The right and left wing portions would be secured to the ledge. There most likely would be structural ribbing along the length of the rectangular portion and means provided to secure the rectangular portion to the ledge and the wall of the building. By employing the protective covering 10 in this fashion, one may solve an age old problem of bird defecation on the ledges of buildings. There would be savings in the regular maintenance which must be done to clean the ledges. The rectangular portion and wing portions may have ornamental appearance which would be pleasing to the eye and in an appropriate style for the building.

It is apparent from the above that the present invention accomplishes all of the objectives set forth by providing a new protective covering for a swim platform which may be placed atop a swim platform of a boat, which is especially adapted to prevent birds from defecating, loitering or nesting on the swim platform, With respect to the above description, it should be realized that the optimum dimensional relationships for the parts of the invention, to include variations in size, materials, shape, form, function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiments of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

What is claimed as being new and desired to be protected by Letters Patent of the United States is as follows:

1. A protective covering for a swim platform located on the stern portion of a boat ,said covering preventing the occupancy of the swim platform by an unauthorized object, said covering, comprising:

a first portion having a right side, a left side, a top side and a bottom side, said first portion intermediate a first wing and a second wing, said first wing attached to said first portion on said left side, said second wing attached to said first portion on said right side, said first and second wing are oriented in an orthogonal position with respect to said first portion and are placed on the swim platform supporting said first portion above the swim platform, said first portion being in angled relation to said swim platform thereby preventing occupancy of the swim platform by an object.

2. A protective covering for a swim platform located on a boat as claimed in claim 1 wherein said left side includes a left side aperture and said right side includes a right side aperture.

3. A protective covering for a swim platform located on a boat as claimed in claim 2 wherein said first wing includes a first wing aperture and said second wing includes a second wing aperture.

4. A protective covering for a swim platform located on a boat as claimed in claim 3 wherein a first attachment device passes through said first wing aperture and said left side aperture and attaches said protective covering to the left side rear of the boat.

5. A protective covering for a swim platform located on a boat as claimed in claim 4 wherein a second attachment device passes through said second wing aperture and said right side aperture and attaches said protective covering to the right side rear of the boat.

6. A protective covering for a swim platform located on a boat as claimed in claim 5 wherein said first attachment device and said second attachment device is an attachment device selected from the group consisting of rope, bungee cord, and straps.

7. A protective covering for a swim platform located on a boat comprising:

a generally rectangular portion having a right side, a left side, a top side and a bottom side, said rectangular portion intermediate a first wing and a second wing, said first wing and said second wing being generally triangular elements, said first wing attached to said rectangular portion on said left side by a first hinge, said second wing attached to said rectangular portion on said right side by a second hinge, whereby said first and second wing are placed on the swim platform thereby forming a generally triangular housing with said rectangular portion in angled relation above the swim platform, with said first wing and second wing acting as legs, said housing preventing occupancy of the swim platform by an object.

8. A protective covering for a swim platform located on a boat as claimed in claim 7 wherein said left side includes a left side aperture and said right side includes a right side aperture.

9. A protective covering for a swim platform located on a boat as claimed in claim 8 wherein said first wing includes a first wing aperture and said second wing includes a second wing aperture.

10. A protective covering for a swim platform located on a boat as claimed in claim 9 wherein a first attachment device passes through said first wing aperture and said left side aperture and attaches said protective covering to the left side rear of the boat.

11. A protective covering for a swim platform located on a boat as claimed in claim 10 wherein a second attachment device passes through said second wing aperture and said right side aperture and attaches said protective covering to the right side rear of the boat.

12. A protective covering for a swim platform located on a boat as claimed in claim 10 wherein said first attachment device and said second attachment device is an attachment device selected from the group consisting of rope, bungee cord, and straps.

13. A protective covering for a swim platform located on a boat comprising:

a generally rectangular portion having a right side, a left side, a top side and a bottom side, said rectangular portion intermediate a first wing and a second wing, said first wing and said second wing being generally triangular elements, said first wing attached to said rectangular portion on said left side by a first hinge, said second wing attached to said rectangular portion on said right side by a second hinge, said left side includes a left side aperture and said right side includes a right side aperture, said first wing includes a first wing aperture and said second wing includes a second wing aperture, whereby said first and second wing are placed on the swim platform thereby forming a generally triangular housing with said rectangular portion in an angled relation above the swim platform, with said first wing and second wing acting as legs, said housing preventing occupancy of the swim platform by an object.

14. A protective covering for a swim platform located on a boat as claimed in claim 13 wherein a first attachment device passes through said first wing aperture and said left side aperture and attaches said protective covering to the left side rear of the boat.

15. A protective covering for a swim platform located on a boat as claimed in claim 14 wherein a second attachment device passes through said second wing aperture and said right side aperture and attaches said protective covering to the right side rear of the boat.

16. A protective covering for a swim platform located on a boat as claimed in claim 15 wherein said first attachment device and said second attachment device is an attachment device selected from the group consisting of rope, bungee cord, and straps.

17. A protective covering for a swim platform located on a boat comprising:

a resilient first portion having a perimeter, said perimeter having a right side, a left side, a top side and a bottom side, said said right side including a right sleeve, said left side including a left sleeve, said top side including a top sleeve, said bottom side including a bottom sleeve, a rigid frame portion, said frame to be retained within said right sleeve, said left sleeve, said top sleeve and said bottom sleeve, said first portion intermediate a first wing and a second wing, said first wing attached to said first portion on said left side by a first attachment device, said second wing attached to said first portion on said right side by a second attachment device, whereby said rigid frame is placed atop the swim platform said first portion being in an angled relation to said swim platform, thereby supporting said first portion above the swim platform, and said first wing and said second wing forming a right and left sidewall, said protective covering preventing occupancy of the swim platform by any object.

18. A protective covering for a swim platform located on a boat as claimed in claim 17 including a flap, said flap attached to a point proximal said bottom sleeve by a third attachment device, said flap, said first wing and said second wing including a weighted portion to retain said first wing and said second wing in a downward position.

19. A protective covering for a swim platform located on a boat as claimed in claim 18 wherein said rigid frame is comprised of interconnected plastic tubing.

20. A protective covering for a swim platform located on a boat as claimed in claim 19 wherein said first attachment device, said second attachment device and said third attachment device are selected from the group consisting of heat welding, stitching, adhesive bonding, and hook and loop fasteners.

* * * * *